US006363856B1

(12) United States Patent
Stoker, Jr. et al.

(10) Patent No.: US 6,363,856 B1
(45) Date of Patent: Apr. 2, 2002

(54) PROJECTILE FOR A SMALL ARMS CARTRIDGE AND METHOD FOR MAKING SAME

(76) Inventors: Roscoe R. Stoker, Jr., 438 Yukon; David A. Stoker, 227 Yukon, both of San Antonio, TX (US) 78221

( * ) Notice: Subject to any disclaimer, the term of this patent is extended or adjusted under 35 U.S.C. 154(b) by 0 days.

(21) Appl. No.: 09/327,862

(22) Filed: Jun. 8, 1999

(51) Int. Cl.[7] ..... F42B 12/74

(52) U.S. Cl. ..... 102/516; 102/507; 102/517; 102/526

(58) Field of Search ..... 102/514–517, 102/507, 508, 509, 510, 501, 524–527

(56) References Cited

U.S. PATENT DOCUMENTS

| | | | | | |
|---|---|---|---|---|---|
| 45,567 | A | * | 12/1864 | Stafford | |
| 47,078 | A | * | 3/1865 | Arick | |
| 1,063,748 | A | * | 6/1913 | Starweather | |
| 2,234,165 | A | * | 3/1941 | Hatcher et al. | |
| 3,987,730 | A | * | 10/1976 | Meadus et al. | |
| 4,245,557 | A | * | 1/1981 | Knappworst et al. | 102/514 |
| 4,471,699 | A | * | 9/1984 | Turco et al. | 102/501 |
| 4,625,650 | A | * | 12/1986 | Bilsbury | 102/516 |
| 4,779,535 | A | * | 10/1988 | Maki | 102/517 |
| 5,097,767 | A | * | 3/1992 | Cirillo | 102/517 |
| 5,349,907 | A | * | 9/1994 | Petrovich et al. | 102/510 |
| 5,440,994 | A | | 8/1995 | Alexander | |
| 5,454,325 | A | * | 10/1995 | LeBlanc | 102/516 |
| 5,535,678 | A | * | 7/1996 | Brown | 102/514 |
| 5,686,693 | A | * | 11/1997 | Jakobsson | 102/514 |
| 5,718,434 | A | | 2/1998 | Alward | |
| 5,723,201 | A | | 3/1998 | Czetto, Jr. | |
| 5,723,807 | A | | 3/1998 | Kuhn, II | |
| 5,726,377 | A | | 3/1998 | Harris et al. | |
| 5,733,643 | A | | 3/1998 | Green | |
| 5,736,474 | A | | 4/1998 | Thomas | |
| 5,763,813 | A | | 6/1998 | Cohen et al. | |
| 5,763,819 | A | * | 6/1998 | Huffman | 102/516 |
| 5,771,489 | A | | 6/1998 | Snedeker | |
| 5,773,370 | A | | 6/1998 | Dunbar et al. | |
| 5,776,838 | A | | 7/1998 | Dellinger | |
| 5,785,779 | A | | 7/1998 | McGee et al. | |

(List continued on next page.)

FOREIGN PATENT DOCUMENTS

| | | | | |
|---|---|---|---|---|
| EP | 578981 | * | 1/1994 | 102/514 |
| GB | 18589 | * | 1/1910 | 102/514 |
| GB | 120774 | * | 11/1918 | 102/501 |
| RU | 2003033 | * | 11/1993 | 102/509 |

*Primary Examiner*—Harold J. Tudor
(74) *Attorney, Agent, or Firm*—Jackson Walker L.L.P.

(57) ABSTRACT

A projectile for small arms, incorporating a core, skirt, and driving band. The present invention's design acts to increase muzzle velocity in three main ways. The core is lightweight, therefore, the same amount of propellent will cause the present invention to be pushed out of the barrel at a higher rate than a conventional heavier bullet. Additionally, a thin skirt circumscribing the base of the projectile is incorporated into it during manufacture. All of the design characteristics of the present invention act to increase the muzzle velocity of the projectile when used with a conventional load as compared to the same load used with a conventional projectile. The increased velocity is achieved in standard small arms without modification to barrels, recoil springs, or other devices. Law enforcement officers must be extremely careful in regard to innocent bystanders who may potentially be hit be an errant bullet, or by a bullet that over-penetrates its target. Most confrontations in which handguns are used take place with the combatants within 50 yards of each other. The projectile of the present invention has a high muzzle velocity for penetration of any protective armor or shield and the intended target, while having a rapid reduction of the projectile's velocity in order to limit the range of the projectile. The present invention accomplishes this by having a lower than conventional density and poor aerodynamics which typically reduce the velocity of the projectile by 80% of its muzzle velocity at 50 yards.

16 Claims, 3 Drawing Sheets

U.S. PATENT DOCUMENTS 5,788,907 A 8/1998 Brown, Jr. et al.
5,789,327 A 8/1998 Rousseau
5,791,417 A 8/1998 Haugen et al.
5,794,320 A 8/1998 Werng et al.
5,796,028 A 8/1998 Field et al.
5,797,140 A 8/1998 Davis et al.
5,798,438 A 8/1998 Sawan et al.
5,804,015 A 9/1998 McCarter et al.
5,804,707 A 9/1998 Scarton
5,804,757 A 9/1998 Wynne
5,811,718 A 9/1998 Bateman
5,811,719 A 9/1998 Madden, Jr.
5,814,250 A 9/1998 Dudt et al.
5,824,940 A 10/1998 Chediak et al.
5,827,992 A 10/1998 Harris et al.
5,829,653 A 11/1998 Kaiser
5,850,033 A 12/1998 Mirzeabasov et al.
5,851,932 A 12/1998 Dickson et al.
5,853,863 A 12/1998 Kim
5,857,215 A 1/1999 Fergason et al.
5,866,066 A 2/1999 Hemphill et al.
5,880,398 A 3/1999 Crilly et al.
6,016,754 A * 1/2000 Enlow et al. ..... 102/516
6,048,379 A * 4/2000 Bray et al. ..... 102/517
6,085,661 A * 7/2000 Halverson ..... 102/516

* cited by examiner

PROJECTILE FOR A SMALL ARMS CARTRIDGE AND METHOD FOR MAKING SAME

BACKGROUND OF THE INVENTION

1. Field of the Invention

Applicant's invention relates to a projectile; and, more particularly, to a projectile having a low density core designed to travel at an increased muzzle velocity as compared to conventional bullet designs when fired from conventional small arms under the same conditions. The lighter weight of the projectile, due to the low density core, acts to quickly reduce the velocity of the projectile after firing. The high muzzle velocity of the projectile allows the projectile to more effectively penetrate body armor, and other solid objects at short ranges, generally under fifty (50) yards. While the rapid velocity loss makes the projectile less dangerous to innocent bystanders if the target is missed, or due to overpenetration. These characteristics make the projectile extremely useful for law enforcement.

2. Background Information

Personal body armor and methods to defeat same have long been a part of history. The advent of modern fire arms may have appeared to have caused the demise of personal body armor. However, relatively inexpensive and wearable fibrous body armor has had a breakthrough occasioned by the development of Kevlar® aramid fiber. As such body armor becomes more accessible, law enforcement is increasingly faced with the task of apprehending individuals with not only increased fire power, but increased personal ballistic protection, making armor piercing slugs a necessity.

The most efficient means for piercing current body armor is increasing the velocity of the projectile at impact. For example, the same bullet proof vest that will stop a bullet from a handgun, will be pierced by a higher velocity bullet from a hunting rifle. The larger cartridges in the hunting rifles allow for increased gun powder, or propellent, in the cartridge. However, it is impractical for most officers to use rifles, they must rely on handguns. The size of handgun cartridges and practical limits on the amount of recoil that is tolerable from a handgun necessitates lesser amounts of propellent. Therefore, in order to increase the velocity of the projectile, other means must be developed.

SUMMARY OF THE INVENTION

The present invention is a projectile for penetrating body armor when fired from convention small arms.

In order to solve the difficulties presented in attempting to increase the muzzle velocity of the slug without increasing the amount of propellent beyond the capability of a standard firearm, a projectile has been developed using three main components: an alloy jacket with a skirt, a lightweight core, and an alloy slug. The present invention's design acts to increase muzzle velocity in three main ways. The core is lightweight, therefore, the same amount of propellent will cause the present invention to be pushed out of the barrel at a higher rate than a conventional heavier bullet. Additionally, a thin skirt circumscribing the base of the projectile is incorporated into it during manufacture. All of the design characteristics of the present invention act to increase the muzzle velocity of the projectile when used with a conventional load as compared to the same load used with a conventional projectile. The increased velocity is achieved in standard small arms without modification to barrels, recoil springs, or other devices.

Additionally, law enforcement officers must be extremely careful in regard to innocent bystanders who may potentially be hit be an errant bullet, or by a bullet that over-penetrates its target. Most confrontations in which handguns are used take place with the combatants within 50 yards of each other. Therefore, another need is for the projectile to have a high muzzle velocity for penetration of any protective armor or shield and the intended target, while having a rapid reduction of the projectile's velocity in order to limit the range of the projectile. The present invention accomplishes this by having a lower than conventional density and poor aerodynamics which typically reduce the velocity of the projectile by 80% of its muzzle velocity at 50 yards.

The advantages of the present invention include: 1) less recoil; 2) increased velocity for a conventional load/barrels; 3) heat transfer reduction; 4) fluid action peeling back the jacket upon entry; 5) quick velocity loss (therefore short range, and less danger to innocent bystanders); 6) increased twist due to higher velocity; 7) increased accuracy; 8) penetration of target at extremely sharp angles; and 9) increased hydrostatic shock upon hitting target.

It should be understood that the size of the projectile, the diameter, length, and weight may vary based upon the caliber of the firearm that is to be used as well as the performance goals for the projectile.

BRIEF DESCRIPTION OF THE DRAWINGS

These and other advantages of the invention will become more readily apparent from the following detailed description of the presently preferred exemplary embodiments, taken together with the accompanying drawings, of which.

DETAILED DESCRIPTION OF THE PREFERRED EMBODIMENT

Turning to the figures, it may be seen that the small arms projectile concept of the present invention includes various embodiments of a projectile configuration that increase the muzzle velocity of the projectile, as compared to conventional projectiles, when fired from a standard small arms using conventional propellent loads for all calibers of small arms.

Figure 1:
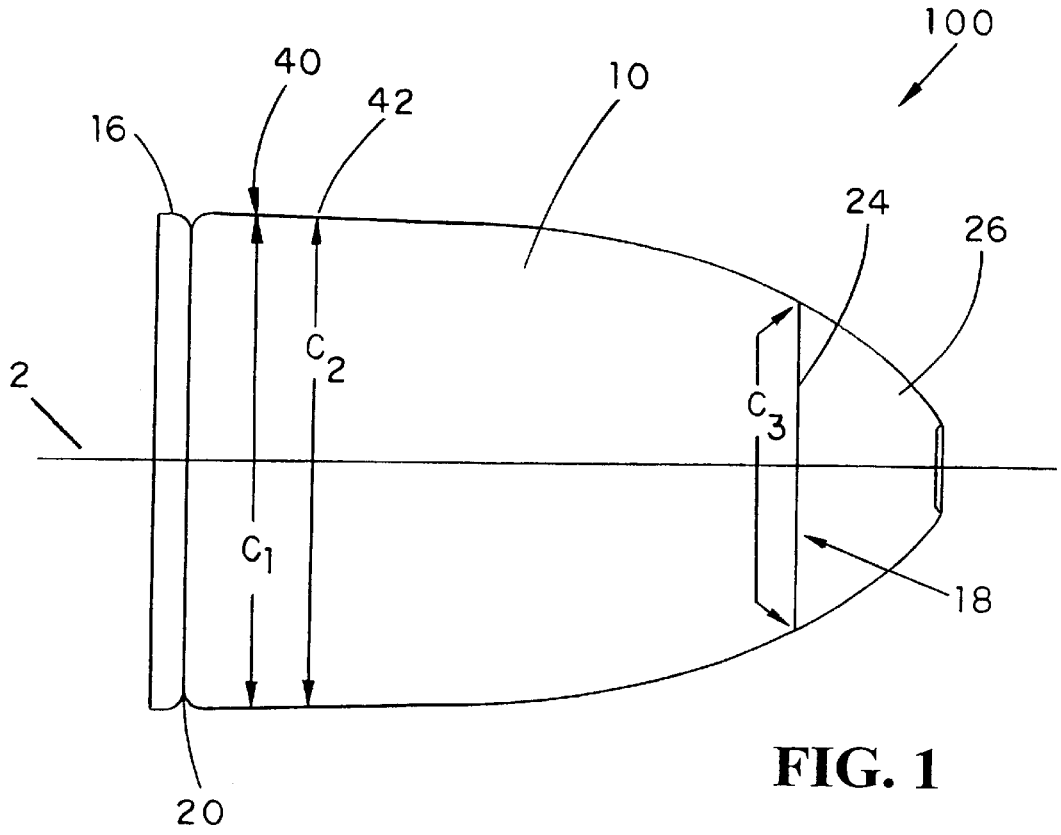
FIG. 1 is a side elevation view of the present invention.

FIG. 1 illustrates a side elevation view of the present invention. The projectile (100) is comprised of a jacket (10) which is cylindrical about a central, longitudinal axis (2—2). The jacket has a base (20) and an opposing aperture (18) circumscribed by a jacket rim (24). Circumscribing and depending rearwardly from the base (20) is a skirt (16) which is generally parallel to said longitudinal axis (2—2). Extending from the aperture (18) is a slug front-end (26). The projectile (100) may be attached to a propellent filled, small arms cartridge (not shown) by inserting the projectile base (20) into an aperture in one end of the cartridge and crimping the lip of the cartridge aperture against the jacket (10).

A driving band (40) is incorporated into the jacket (10) of the projectile (100) near its base (20). The jacket (10) has a first circumference ($C_1$) that is calibrated to fit in various calibers of small arms barrels, and contact the lands (38, from FIG. 6) of the barrels (34, from FIG. 6). The first circumference ($C_1$) is relatively constant and extends from the base (20) to a driving band shoulder (42) which has a smaller, second circumference ($C_2$). The second circumference ($C_2$) gradually tapers to a third circumference ($C_3$) at the aperture (18). The driving band rides on the lands (38) of the barrel (34), while the remaining forward portion of the projectile (100) does not touch the barrel (34). This acts to reduce friction of the projectile (100) against the barrel (34) as it travels through the barrel (34) as compared to a conventional projectile.

The jacket (10) is made from a first metallic alloy. A preferred composition of the first metallic alloy is 75% to 95% copper, up to 8% molybdenum, up to 15% zinc, up to 8% nickel, and up to 7% silicon. The jacket (10) alloy reduces both barrel friction and wear, and helps control expansion.

Figure 2:
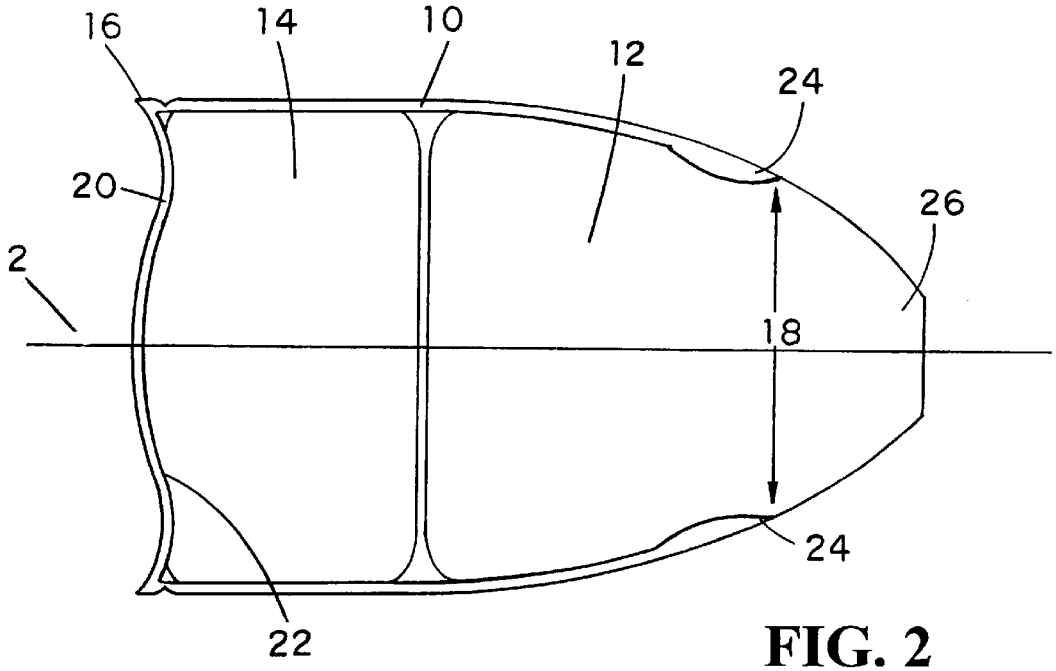
FIG. 2 is a cross-sectional elevation view of the present invention taken along line 2—2 of FIG. 1.

FIG. 2 depicts a cross-sectional elevation view of the projectile (100) taken along a central, longitudinal axis (2—2). The core (14) is shown inserted into the jacket (10), compressed and urged against the inner side (22) of the base (20). The slug (12) is inserted into the aperture (18) and is urged against the core (14). The slug front-end (26) extends beyond the aperture (18). The jacket (10) is thicker near the aperture (18). The skirt (16) circumscribes and depends downwardly from the base (20) and generally parallel to the longitudinal axis (2—2).

The material used to make the core (14) has a lower density than the alloy used to make the slug (12). Preferably, the core (14) should have a density of less than 7 g/cm$^3$. Additionally, the core (14) material should preferably be malleable during a curing period, and have elastic properties after curing. The core (14) can be made from various lightweight substances that have the required physical property of being less dense than the slug (12), however polymers, epoxies, and plastics are particularly well suited for use as core (14) materials. A polymer is a long-chain molecule synthesized by linking together multiple, nonredundant monomers. Plastics are polymers that are moldable when hot, but retain their shape when cooled. Epoxies are generally a combination of polymer chains and curing agents which chemically bind the polymeric chains together. A preferred composition of the core (14) is Scotch-Weld™ epoxy adhesive DP-190 gray, manufactured by 3M Industrial Specialties Division. Scotch-Weld™ gray contains epoxy resin, kaolin, polymeric diamine, and carbon black. The composition of a preferred embodiment of the core (14) includes 30% to 45% epoxy resin, 20% to 42.5% kaolin, and 22.5% to 40% polymeric diamine. An alternative preferred composition of the core (14) is Scotch-Weld™ epoxy adhesive DP-190 translucent, manufactured by 3M Industrial Specialties Division. Scotch-Weld™ translucent contains epoxy resin, amine terminated polymer, and sulfonic acid salt. The composition of the alternative preferred embodiment of the core (14) includes 40% to 60% epoxy resin, and 40% to 55% amine terminated polymer. It should be understood that the core (14) may be made from any of a vast array of lightweight materials, particularly polymer, epoxy, and plastic compositions, that are of sufficient low density. The densities of Scotch-Weld™ gray and Scotch-Weld™ translucent range from between 0.9 g/cm$^3$ to 1.5 g/cm$^3$. The core's (14) elastic properties help control expansion, retain energy, increase energy transfer, and increase penetration of the projectile (100).

The slug (12) is made from a second metallic alloy. A preferred composition of the slug (12) is 30% to 50% bismuth, up to 40% lead, up to 20% molybdenum, up to 40% epoxy such as Scotch-Weld™ gray or Scotch-Weld™ translucent, up to 15% aluminum, and up to 15% zinc. The epoxy, such as Scotch-Weld™ gray or Scotch-Weld™ translucent, is used to bind the metallic powders together.

The projectile (100) is designed to lose velocity faster than conventional small arm projectiles. The core (14) has a lower density than the slug (12), therefore the projectile (100) is relatively light as compared to conventional bullets. The slug front end (26) has a poor aerodynamic shape. The projectile's (100) relative light weight per volume ratio results in a lower function sectional density than conventional projectiles, and the shape of the slug front end (26) results in a lower ballistic coefficient. Both of these factors act to more rapidly decrease the velocity of the projectile (100). At 25 yards the velocity is typically decreased approximately 40%, and at 50 yards the velocity is typically decreased approximately 80%. While the projectile (100) will fly farther, the projectile's (100) intended range is within 50 yards. This characteristic decreases the danger to unintended targets such as innocent bystanders and structures.

The core (14) may have elastic properties. During manufacture, the slug (12) is pressed into the aperture (18) of the projectile jacket (10) against the core (14), slightly compressing the core (14). The jacket rim (24) is thicker than the remainder of the jacket (10). When the projectile (100) hits its target, particularly in liquid, the jacket rim (24) peels away from the slug (12) which allows the core (14) to decompress thereby adding energy to the slug (12) as it penetrates the target. The peeling away of the jacket (10) also creates a controlled expansion that causes the projectile (100) to fragment upon penetration. The fragmentation and additional energy cause an increased hydrostatic shock wave increasing "knock-down" impact and damage to the target. Additionally, despite an increased muzzle velocity, the expansion causes the projectile (100) to be less likely to over-penetrate or ricochet. The reduction in over-penetration and ricochets make the present invention less likely to hit unintended targets.

The core (14) also acts as an insulator from the high heat that develops from the gases that propel the projectile (100) through the barrel of the gun. As the projectile (100) travels through the barrel of the gun, the rifling of the barrel causes the projectile (100) to rotate. Heat develops behind the projectile (100) heating the projectile jacket (10). In a conventional bullet, this heat will act to melt or soften the slug inside the jacket. Therefore, in a conventional bullet, the jacket rotates with the rifling while the slug has entered into a molten state and does not rotate. Once the conventional projectile leaves the gun barrel the slug resolidifies and has to "catch up" to the rotation of the projectile. This "catch up" can cause a reduction in accuracy. The current invention's core (14) acts as a heat insulator. Therefore, the slug (12) does not melt and, instead, rotates with the projectile (100) as the projectile (100) travels through the barrel. As a result, there is no "catch up" to be made by the slug (12), resulting in an increase in accuracy.

The projectile (100) is produced by inserting a core (14) into an aperture (18) of a jacket (10); inserting a slug (12) into the aperture (18) above said core (14); applying pressure so that the slug (12) is compressed against the core (14); and compressing the jacket rim (24) inwardly against the slug (12) to retain the slug (12) and core (14) in the jacket (10), with the slug front end (26) extending outwardly beyond the jacket rim (24) and shaped by the pressure applied. The skirt (16) is further formed by the step of compressing the slug (12) and core (14). The pressure urges the jacket (10) to form a skirt (16) depending downwardly from, and circumscribing, the base (20) of the jacket (10). The resulting skirt (16) is generally parallel to a longitudinal axis (2—2) running through the center of the projectile (100).

Figure 3:
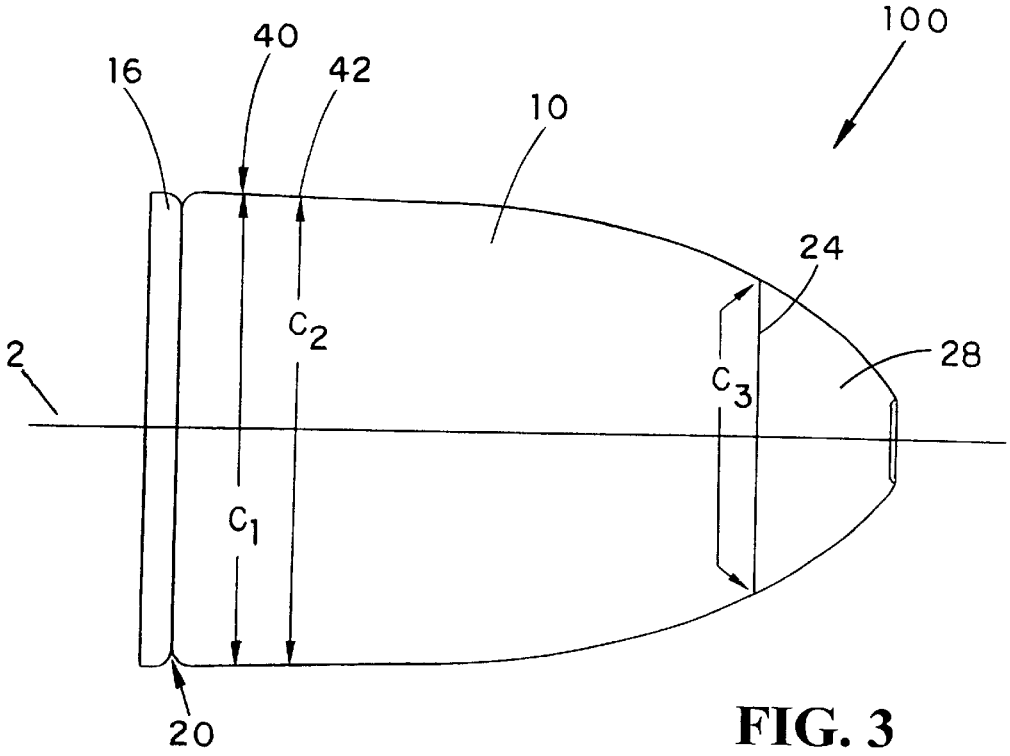
FIG. 3 is a side elevation view of an alternative embodiment of the present invention.

The volume of the core (14) can be varied by the manufacturer based upon performance goals. By increasing the core (14) volume to slug (12) volume ratio, the projectile (100) is made progressively lighter. Generally, the core (14) weight will be in the range of 6 to 12 grains for conventional calibers of handguns. However, the present invention's slug (12) can be removed and the projectile (100) manufactured with only a jacket (10) and expanded core (14) which is inserted into the jacket (10) and "pressed" to form a light-weight payload (30). FIG. 3 illustrates a side elevation view of this alternative embodiment of the present invention. The embodiment of the present invention which incorporates only a jacket (10) and payload (30) is extremely light as compared to conventional small arms projectiles.

The projectile (100) is comprised of a jacket (10) which is cylindrical about a central, longitudinal axis (2—2). The jacket has a base (20) and an opposing aperture (18) circumscribed by a jacket rim (24). Circumscribing and depending downwardly from the base (20) is a skirt (16) which is generally parallel to said longitudinal axis (2—2). The jacket (10) has a driving band (42) formed by a first circumference ($C_1$) that is calibrated to fit in various calibers of small arm barrels, and lightly contact the lands (38, from FIG. 6) of the barrels (34, from FIG. 6). The first circumference ($C_1$) is relatively constant and extends from the base (20) to a driving band shoulder (42) which has a smaller, second circumference ($C_2$). The second circumference ($C_2$) gradually tapers to a third circumference ($C_3$) at the aperture (18). Extending from the aperture (18) is a payload front-end (28).

Figure 4:
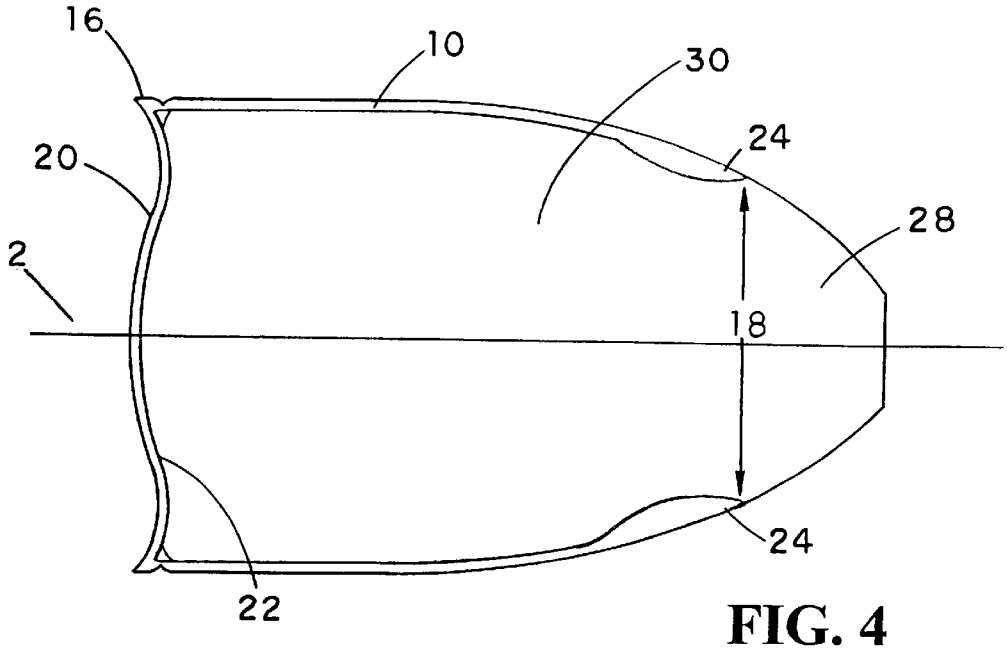
FIG. 4 is a cross-sectional elevation view of the present invention taken along line 3—3 of FIG. 3.

FIG. 4 is a cross-sectional elevation view of the alternative embodiment of the present invention taken along line 2—2 of FIG. 3. The payload (30) is shown as inserted into the jacket (10), urged against the inner side (22) of the base (20). The payload front-end (28) extends beyond the aperture (18). The payload (30) is made of the same group of compositions as the core (14) with the additional limitation that the material used for the payload must be rigid upon curing, and a preferred embodiment uses Scotch-Weld™ DP-190 gray or translucent. The jacket (10) is shown thicker near the aperture (18). The skirt (16) is shown circumscribing and depending downwardly from the base (20) and generally parallel to said longitudinal axis (2—2).

Figure 5:
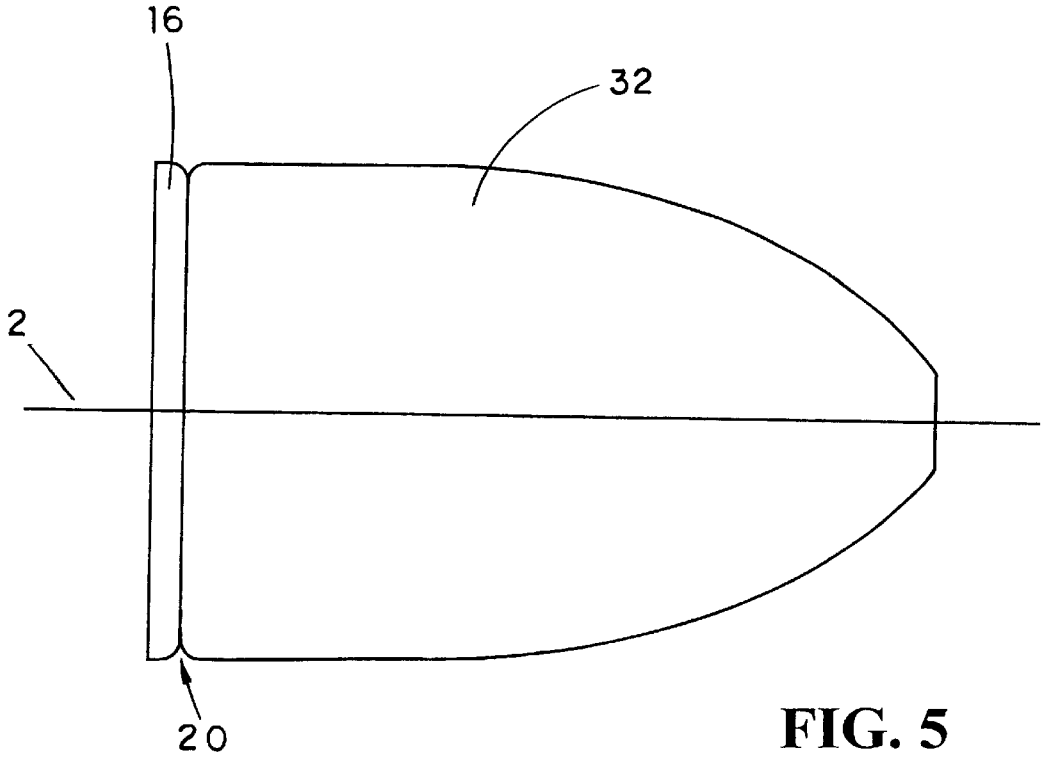
FIG. 5 is a side elevation view of a second alternative embodiment of the present invention.

FIG. 5 is a side elevation view of yet another alternative embodiment of the present invention. The projectile (100) is comprised of a body member (32), and a base (20). Circumscribing and depending downwardly from the base (20) is a skirt (16) which is generally concentric about to the central, longitudinal axis (2—2).

Figure 6:
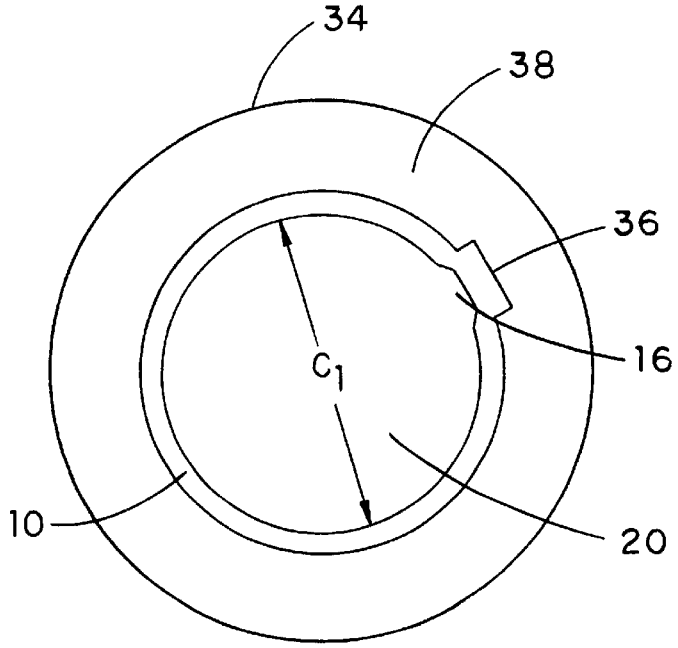
FIG. 6 is a rear elevation view of the projectile inside of a small arms barrel.

FIG. 6 is a rear elevation view of the projectile (100) inside of a small arms barrel (34). A portion of the jacket (10) contacts the lands (38) of the barrel (34). Upon firing, the skirt (16) generally fills the rifling (36) of the barrel (34) and thereby reduces the escape of gases past the projectile (100). The skirt (16) causes a larger percentage of the gases developed upon firing to be used to push against the base (20), driving the projectile (100) through the barrel (34).

Although the invention has been described with reference to specific embodiments, this description is not meant to be construed in a limited sense. It should be understood that the materials of the core composition and the metallic alloys may be altered, or substituted for with other materials having similar physical properties. Additionally, the size (or volume) of the projectile's core may be increased or decreased relative to the size (or volume) of the slug. As shown in an alternative embodiment, the core may be increased to point that no slug is used, rather the core becomes the entire payload of the projectile contained within the jacket. The projectiles other attributes may also be changed depending upon use. For example, the size of the projectile may be altered based upon the caliber of the firearm that is to be used. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A projectile for a small arms cartridge, comprising:

a cylindrical jacket made from a first metallic alloy, said jacket having a base, a jacket rim circumscribing a jacket aperture, and a longitudinal axis;

a core received into said jacket aperture and urged against an inner side of said base;

a second metallic alloy slug received into said jacket aperture and urged against said core, a front end of said slug extending outwardly beyond said jacket aperture; and said core has a lesser density than said second metallic alloy wherein said core is comprised of about 30% to 45% epoxy resin, about 20% to 42.5% Kaolin, and about 22.5% to 40% polymeric diamine.

2. The projectile of claim 1 further comprising:

a skirt depending downwardly from, and circumscribing, said base of said jacket, said skirt generally parallel to said longitudinal axis.

3. The projectile of claim 1 wherein:

said first metallic alloy is comprised of 75% to 95% copper, up to 8% molybdenum, up to 15% zinc, up to 8% nickel, and up to 7% silicon.

4. The projectile of claim 1 wherein:

said second metallic alloy is comprised of 30% to 50% bismuth, up to 40% lead, up to 20% molybdenum, up to 40% polymer, up to 15% aluminum, and up to 15% zinc.

5. The projectile of claim 1 wherein:

said core has elastic properties.

6. The projectile of claim 1 wherein:

said core has a density of up to 7 g/cm$^3$.

7. The projectile of claim 1 wherein:

said jacket has a first circumference at said base of said jacket greater than a second circumference near said base;

said second circumference tapering to a third circumference at said jacket aperture.

8. The projectile of claim 1 wherein:

said jacket rim has a greater thickness than said jacket.

9. A projectile for a small arms cartridge, comprising:

a cylindrical jacket made from a first metallic alloy, said jacket having a base, a jacket rim circumscribing a jacket aperture, and a longitudinal axis;

a core received into said jacket aperture and urged against an inner side of said base;

a second metallic alloy slug received into said jacket aperture and urged against said core, a front end of said slug extending outwardly beyond said jacket aperture; and said core has a lesser density than said second metallic alloy wherein said core is comprised of about 40% to 60% epoxy resin, about 40% to 55% amine terminated polymer.

10. The projectile of claim 9 further comprising:

a skirt depending downwardly from, and circumscribing, said base of said jacket, said skirt generally parallel to said longitudinal axis.

11. The projectile of claim 9 wherein:

said first metallic alloy is comprised of 75% to 95% copper, up to 8% molybdenum, up tp 15% zinc, up to 8% nickel, and up to 7% silicon.

12. The projectile of claim 9 wherein:

said second metallic alloy is comprised of 30% to 50% bismuth, up to 40% lead, up to 20% molybdenum up to 40% polymer, up to 15% aluminum, and up to 15% zinc.

13. The projectile of claim 9 wherein:

said core has elastic properties.

14. The projectile of claim 9 wherein:

said core has a density of up to 7 $g/cm^3$.

15. The projectile of claim 9 wherein:

said jacket has a first circumference at said base of said jacket greater than a second circumference near said base;

said second circumference tapering to a third circumference at said jacket aperture.

16. The projectile of claim 9 wherein:

said jacket rim has a greater thickness than said jacket.

* * * * *